US011643745B2

(12) United States Patent
Kato et al.

(10) Patent No.: US 11,643,745 B2
(45) Date of Patent: May 9, 2023

(54) FILM FORMATION DEVICE AND FILM FORMATION METHOD FOR METALLIC COATING

(71) Applicant: TOYOTA JIDOSHA KABUSHIKI KAISHA, Toyota (JP)

(72) Inventors: Akira Kato, Toyota (JP); Haruki Kondoh, Toyota (JP); Soma Higashikozono, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/468,746

(22) Filed: Sep. 8, 2021

(65) Prior Publication Data

US 2022/0081797 A1 Mar. 17, 2022

(30) Foreign Application Priority Data

Sep. 16, 2020 (JP) ..... JP2020-155163

(51) Int. Cl.

| | |
|---|---|
| ***C25D 17/00*** | (2006.01) |
| ***C25D 17/10*** | (2006.01) |
| ***C25D 1/00*** | (2006.01) |
| ***C25D 21/14*** | (2006.01) |

(52) U.S. Cl.

CPC ..... *C25D 17/008* (2013.01); *C25D 1/00* (2013.01); *C25D 17/002* (2013.01); *C25D 17/10* (2013.01); *C25D 21/14* (2013.01)

(58) Field of Classification Search

CPC ..... C25D 17/002; C25D 17/008

See application file for complete search history.

(56) References Cited

U.S. PATENT DOCUMENTS

| | | | | |
|---|---|---|---|---|
| 8,623,193 | B1 * | 1/2014 | Mayer | C25D 17/001 205/97 |
| 10,017,869 | B2 * | 7/2018 | Mayer | H01L 21/2885 |
| 2012/0292195 | A1 * | 11/2012 | Lee | H01L 21/2885 205/133 |
| 2013/0137242 | A1 * | 5/2013 | He | C25D 7/123 204/229.4 |
| 2021/0054521 | A1 * | 2/2021 | Shimomura | H01L 21/68721 |

FOREIGN PATENT DOCUMENTS

| | | | |
|---|---|---|---|
| JP | 2014-051701 | A | 3/2014 |

* cited by examiner

*Primary Examiner* — Stefanie S Wittenberg
(74) *Attorney, Agent, or Firm* — Sughrue Mion, PLLC

(57) ABSTRACT

Provided is a film formation device and a film formation method for a metallic coating that allow forming a metallic coating with a uniform film thickness. The film formation device of the present disclosure includes an anode, a solid electrolyte membrane, a power supply device, a solution container, and a pressure device. The solid electrolyte membrane is disposed between the anode and a substrate that serves as a cathode. The power supply device applies a voltage between the anode and the cathode. The solution container contains a solution between the anode and the solid electrolyte membrane. The solution contains metal ions. The pressure device pressurizes the solid electrolyte membrane to the cathode side with a fluid pressure of the solution. The film formation device further includes a shielding member disposed to surround an outer peripheral surface of the anode. The shielding member shields a line of electric force.

3 Claims, 13 Drawing Sheets

FILM FORMATION DEVICE AND FILM FORMATION METHOD FOR METALLIC COATING

CROSS REFERENCE TO RELATED APPLICATIONS

The present application claims priority from Japanese patent application JP 2020-155163 filed on Sep. 16, 2020, the entire content of which is hereby incorporated by reference into this application.

BACKGROUND

Technical Field

The present disclosure relates to a film formation device and a film formation method for a metallic coating, and especially relates to a film formation device and a film formation method for a metallic coating that allow forming the metallic coating on a surface of a substrate.

Description of Related Art

Conventionally, there has been known a film formation device and a film formation method in which metal ions are deposited to form a metallic coating. For example, JP 2014-51701 A proposes a film formation device and a metallic coating method using the device. The film formation device includes an anode, a solid electrolyte membrane disposed between the anode and a substrate that serves as a cathode, a power supply device that applies a voltage between the anode and the cathode, a solution container that contains a solution containing metal ions between the anode and the solid electrolyte membrane, and a pressure device that pressurizes the solid electrolyte membrane to the cathode side with a fluid pressure of the solution. The solid electrolyte membrane is disposed to seal an opening in the cathode side of the solution container.

When a metallic coating is formed on a surface of a substrate by this film formation method for the metallic coating, the solid electrolyte membrane is brought in contact with the surface of the substrate, and subsequently, the metal ions internally contained in the solid electrolyte membrane are deposited by applying a voltage while pressurizing the surface of the substrate by the solid electrolyte membrane with a fluid pressure of a solution, thus forming the metallic coating on the surface of the substrate.

SUMMARY

In the conventional film formation device and film formation method for the metallic coating, when the metallic coating is formed on the surface of the substrate, lines of electric force from the anode are locally concentrated in a peripheral edge portion of a film formation region in the surface of the substrate, and a current is concentrated on the peripheral edge portion of the film formation region, thus possibly causing current density variations in the film formation region. Consequently, the metal ions are excessively deposited in the peripheral edge portion of the film formation region in the surface of the substrate, and a film thickness of the metallic coating increases, thereby possibly failing to form the metallic coating with a uniform film thickness.

The present disclosure has been made in consideration of such a situation and provides a film formation device and a film formation method for a metallic coating that allow forming the metallic coating with a uniform film thickness.

To solve the above-described problem, a film formation device for a metallic coating of the present disclosure comprises an anode, a solid electrolyte membrane, a power supply device, a solution container, and a pressure device. The solid electrolyte membrane is disposed between the anode and a substrate that serves as a cathode. The power supply device applies a voltage between the anode and the cathode. The solution container contains a solution between the anode and the solid electrolyte membrane. The solution contains metal ions. The pressure device pressurizes the solid electrolyte membrane to the cathode side with a fluid pressure of the solution. A metallic coating is formed on a surface of the substrate by applying the voltage while pressurizing the surface of the substrate by the solid electrolyte membrane to deposit the metal ions internally contained in the solid electrolyte membrane. The film formation device for the metallic coating further comprises a shielding member disposed to surround an outer peripheral surface of the anode. The shielding member shields a line of electric force.

With the film formation device for the metallic coating of the present disclosure, the metallic coating can be formed with a uniform film thickness.

Furthermore, a film formation method for a metallic coating of the present disclosure is a film formation method for a metallic coating. The film formation method comprises: disposing a solid electrolyte membrane between an anode and a substrate that serves as a cathode; forming a metallic coating on a surface of the substrate by applying a voltage between the anode and the cathode while pressurizing the surface of the substrate by the solid electrolyte membrane with a fluid pressure of a solution to deposit metal ions internally contained in the solid electrolyte membrane, the solution is disposed between the anode and the solid electrolyte membrane, and the solution contains the metal ions; and forming the metallic coating by applying the voltage in a state where a shielding member is disposed to surround an outer peripheral surface of the anode, and the shielding member shields a line of electric force.

With the film formation method for the metallic coating of the present disclosure, the metallic coating can be formed with the uniform film thickness.

Effect

With the present disclosure, the metallic coating can be formed with the uniform film thickness.

DETAILED DESCRIPTION OF THE EMBODIMENTS

The following describes embodiments of a film formation device and a film formation method for a metallic coating according to the present disclosure.

Figure 1:
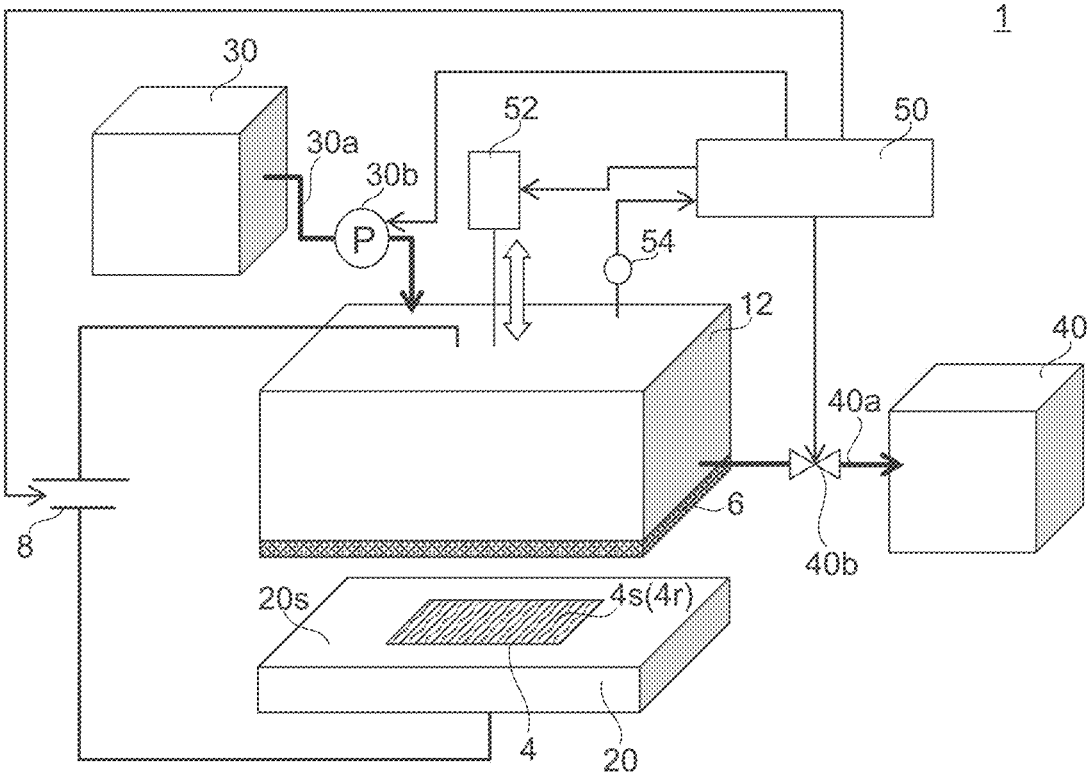
FIG. 1 is a schematic perspective view illustrating a film formation device for a metallic coating according to a first embodiment.
Figure 2A:
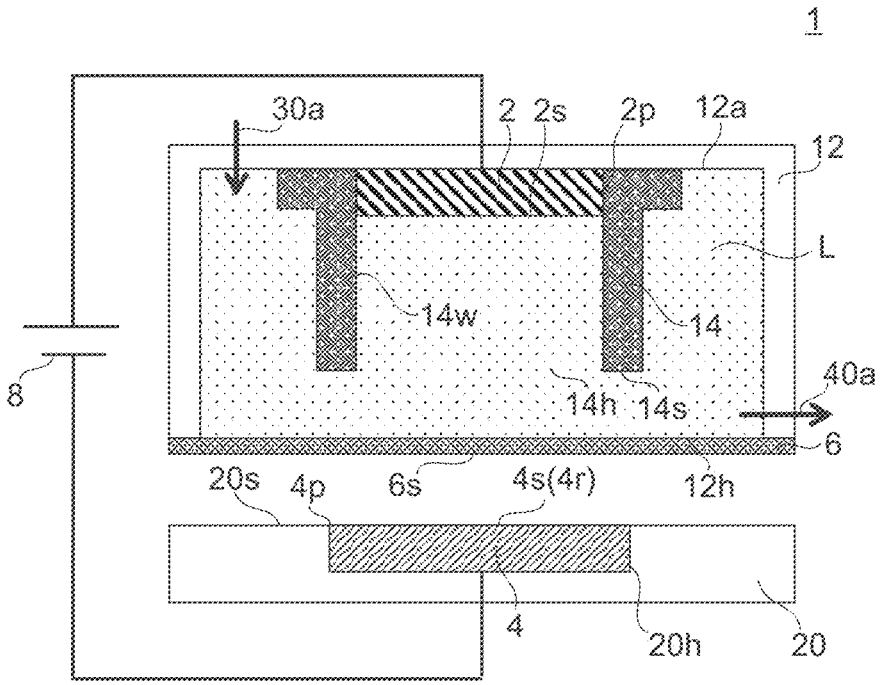
FIG. 2A is a schematic process cross-sectional view illustrating a film formation method for the metallic coating according to the first embodiment, and illustrates a schematic cross-sectional surface of a main part including a solution container and a substrate of the film formation device illustrated in FIG. 1.
Figure 2B:
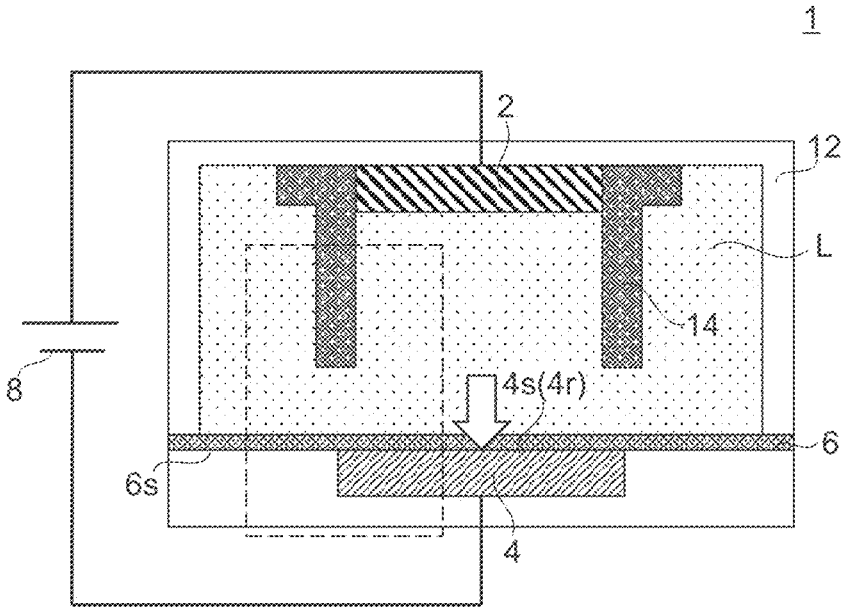
FIG. 2B is a schematic process cross-sectional view illustrating the film formation method for the metallic coating according to the first embodiment.
Figure 2C:
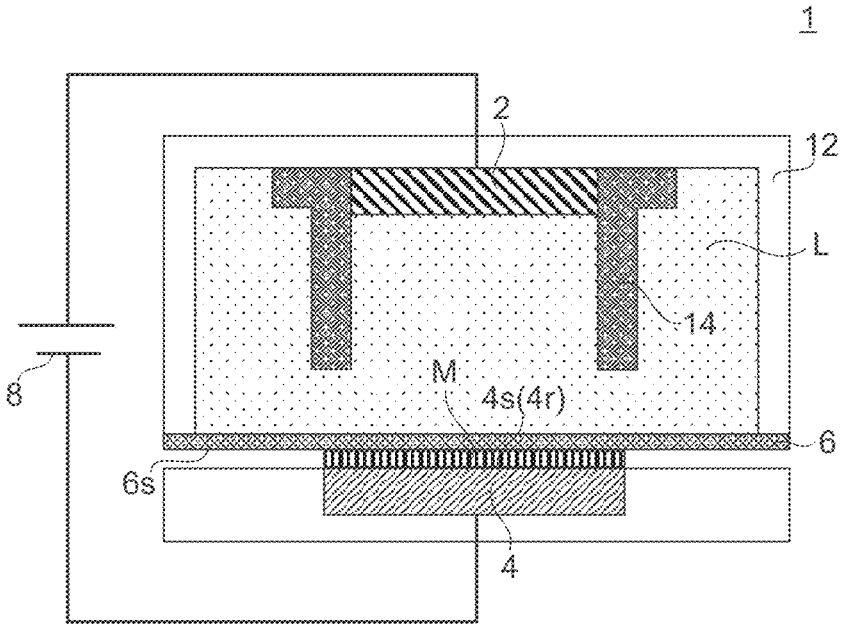
FIG. 2C is a schematic process cross-sectional view illustrating the film formation method for the metallic coating according to the first embodiment.
Figure 3:
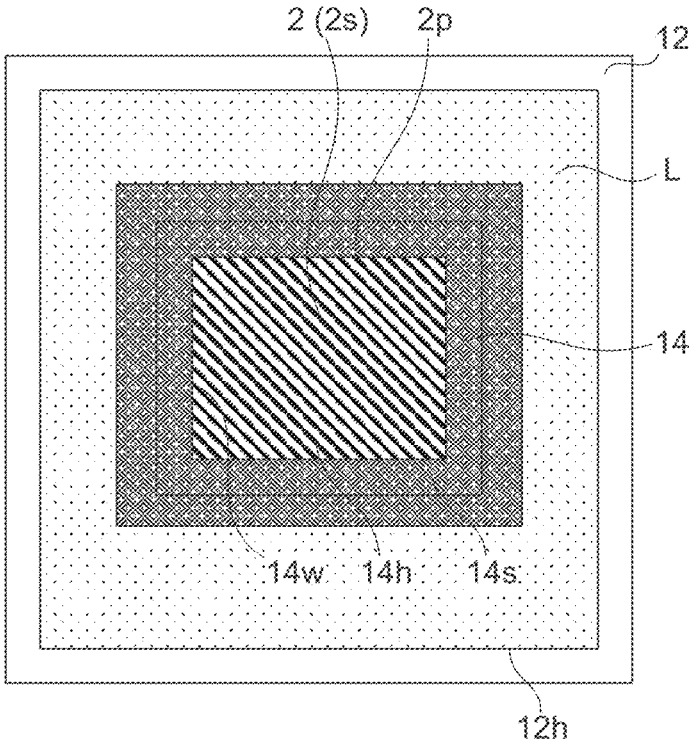
FIG. 3 is a schematic plan view illustrating the solution container of the film formation device illustrated in FIG. 1 from a cathode side in plan view.
Figure 4A:
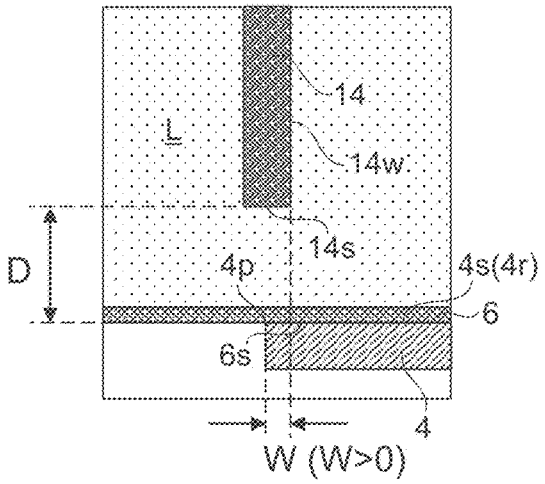
FIG. 4A is an enlarged view of a part inside a broken-line frame of FIG. 2B.

First, the embodiment will be schematically described with a film formation device and a film formation method for a metallic coating according to a first embodiment as an example. FIG. 1 is a schematic perspective view illustrating the film formation device for the metallic coating according to the first embodiment. FIG. 2A to FIG. 2C are schematic process cross-sectional views illustrating the film formation method for the metallic coating according to the first embodiment, and FIG. 2A illustrates a schematic cross-sectional surface of a main part including a solution container and a substrate of the film formation device illustrated in FIG. 1. FIG. 3 is a schematic plan view illustrating the solution container of the film formation device illustrated in FIG. 1 from a cathode side in plan view. FIG. 4A is an enlarged view of a part inside a broken-line frame of FIG. 2B.

As illustrated in FIG. 1 and FIG. 2A, a film formation device 1 for the metallic coating according to the first embodiment includes an anode 2, a solid electrolyte membrane 6, a power supply device 8, a solution container 12, and a pump (pressure device) 30*b*. The solid electrolyte membrane 6 is disposed between the anode 2 and a substrate 4 that serves as a cathode. The power supply device 8 applies a voltage between the anode 2 and the substrate (cathode) 4. The solution container 12 contains a solution (hereinafter referred to as a "metal ion solution" in some cases) L containing metal ions between the anode 2 and the solid electrolyte membrane 6. The pump (pressure device) 30*b* pressurizes the solid electrolyte membrane 6 to the cathode side with a fluid pressure of the metal ion solution L.

The anode 2 is disposed on an upper surface 12*a* inside the solution container 12, contained in the solution container 12 so as to be in contact with the metal ion solution L, and electrically connected to the power supply device 8. The anode 2 has a surface 2*s* parallel to an end surface 6*s* in the cathode side of the solid electrolyte membrane 6. Since the substrate 4 is embedded in a groove portion 20*h* of a pedestal 20, the surface 4*s* of the substrate 4 is disposed on the same plane as a surface 20*s* of the pedestal 20. The substrate 4 is electrically connected to the power supply device 8. The whole of the surface 4*s* of the substrate 4 constitutes a film formation region 4*r*. A shape of the anode 2 in plan view is similar to a rectangle of a shape of the film formation region 4*r* in plan view as illustrated in FIG. 3. A size of the anode 2 in plan view is slightly smaller than a size of the film formation region 4*r* in plan view. The solution container 12 is provided with an opening 12*h* in the cathode side. The solid electrolyte membrane 6 is disposed to cover the opening 12*h* of the solution container 12. The power supply device 8 is electrically connected to a control device 50, and can receive control signal from the control device 50 to control the voltage between the anode 2 and the substrate 4. The pedestal 20 is formed of a material that has an insulation property and a chemical resistance to the metal ion solution.

As illustrated in FIG. 2A and FIG. 3, the film formation device 1 for the metallic coating further includes a shielding member 14 disposed to surround an outer peripheral surface 2*p* of the anode 2. The shielding member 14 shields lines of electric force. The shielding member 14 extends toward the cathode side with respect to the anode 2. The shielding member 14 is provided with an opening 14*h* in the cathode side. As illustrated in FIG. 3, a shape of the shielding member 14 in plan view is a rectangular frame shape, and a shape and a size of the opening 14*h* of the shielding member 14 in plan view are the same as those of the anode 2.

In the film formation device 1 for the metallic coating, as illustrated in FIG. 1, a solution tank 30 that contains the metal ion solution L is connected to one side of the solution container 12 via a supply pipe 30*a*, and the pump (pressure device) 30*b* is disposed to the supply pipe 30*a*. A waste liquid tank 40 that collects a waste liquid of the metal ion solution L after the film formation is connected to the other side of the solution container 12 via a waste liquid pipe 40*a*, and an open/close valve 40*b* is disposed to the waste liquid pipe 40*a*. The pump 30*b* and the open/close valve 40*b* are electrically connected to the control device 50, and can receive control signal from the control device 50 to control their operations. This configuration of the film formation device 1 allows making the inside of the solution container 12 a closed space to contain the metal ion solution L by closing the open/close valve 40*b*. Driving the pump 30*b* allows supplying the metal ion solution L to the closed space from the solution tank 30 via the supply pipe 30*a*, thereby allowing controlling the fluid pressure of the metal ion solution L contained in the closed space to a desired value. Opening the open/close valve 40*b* allows transmitting the waste liquid of the metal ion solution L after the film formation to the waste liquid tank 40 via the waste liquid pipe 40*a*.

Furthermore, in the film formation device 1 for the metallic coating, a moving apparatus 52 is connected to an upper portion of the solution container 12. The moving apparatus 52 moves the solution container 12 together with the solid electrolyte membrane 6 toward the substrate 4, thereby bringing the solid electrolyte membrane 6 into contact with the film formation region 4*r* in the surface 4*s* of the substrate 4. The moving apparatus 52 is electrically connected to the control device 50, and can receive control signal from the control device 50 to control the operation.

A pressure gauge 54 that measures the fluid pressure of the metal ion solution L contained in the closed space inside the solution container 12 is disposed. The pressure gauge 54 is electrically connected to the control device 50, and can output a fluid pressure value of the metal ion solution L measured by the pressure gauge 54 as a signal.

The control device 50 is electrically connected to the power supply device 8, the pump 30*b* and the open/close valve 40*b*, the moving apparatus 52, and the pressure gauge 54. The control device 50 can output control signal to control the power supply device 8, the pump 30*b* and the open/close valve 40*b*, and the moving apparatus 52, and can receive the fluid pressure value output as the signal from the pressure gauge 54.

In the film formation method for the metallic coating according to the first embodiment, the film formation device 1 for the metallic coating is used to form a metallic coating M on the film formation region 4*r* in the surface 4*s* of the substrate 4. The following describes the process.

First, as illustrated in FIG. 1 and FIG. 2A, the substrate 4 is embedded in the groove portion 20*h* of the pedestal 20 such that the surface 4*s* of the substrate 4 and the surface 20*s* of the pedestal 20 are disposed on the same plane, and the power supply device 8 is electrically connected to the substrate 4. Subsequently, the solid electrolyte membrane 6 is disposed between the anode 2 and the substrate 4 that serves as the cathode. At this time, an alignment of the substrate 4 with respect to the anode 2 is adjusted such that the surface 2*s* of the anode 2 is parallel to the surface 4*s* of the substrate 4, and the outer peripheral surface 2*p* of the anode 2 is disposed inside a peripheral edge 4*p* of the film formation region 4*r* in the surface 4*s* of the substrate 4 in plan view.

Next, inputting control signal from the control device 50 drives the moving apparatus 52, thereby moving the solid electrolyte membrane 6 together with the solution container 12 toward the substrate 4 as illustrated in FIG. 2B, thus bringing the end surface 6*s* in the cathode side of the solid electrolyte membrane 6 into contact with the film formation region 4*r* in the surface 4*s* of the substrate 4. At this time, as illustrated in FIG. 4A, an end surface 14*s* in the cathode side of the shielding member 14 is opposed to the peripheral edge portion of the film formation region 4*r* in the surface 4*s* of the substrate 4 (shielding member reduction width W>0).

Next, inputting control signal from the control device 50 closes the open/close valve 40*b*, thereby making the inside of the solution container 12 the closed space to contain the metal ion solution L. Subsequently, in this state, inputting control signal from the control device 50 drives the pump 30*b*, thereby supplying the metal ion solution L to the closed space from the solution tank 30 via the supply pipe 30*a*, thus controlling the fluid pressure, which is measured by the pressure gauge 54, of the metal ion solution L contained in the closed space to a desired value. Furthermore, inputting control signal from the control device 50 controls the power supply device 8, thereby applying a voltage between the anode 2 and the substrate 4, thus controlling the voltage to a desired value. Thus, as illustrated in FIG. 2C, the voltage is applied between the anode 2 and the substrate 4 while pressurizing the film formation region 4*r* in the surface 4*s* of the substrate 4 by the solid electrolyte membrane 6 with the fluid pressure of the metal ion solution L containing the metal ions disposed between the anode 2 and the solid electrolyte membrane 6, thereby depositing the metal ions internally contained in the solid electrolyte membrane 6. Accordingly, the metallic coating M is formed on the film formation region 4*r* in the surface 4*s* of the substrate 4.

Therefore, according to the film formation device and the film formation method for the metallic coating of the first embodiment, the lines of electric force from the anode 2 are shielded by the shielding member 14 by applying the voltage between the anode 2 and the substrate 4 in a state where the shielding member 14 for shielding the lines of electric force is disposed to surround the outer peripheral surface 2*p* of the anode 2, thereby allowing suppressing concentration of the current to the peripheral edge portion of the film formation region 4*r* in the surface 4*s* of the substrate 4. Accordingly, since the current density variation in the film formation region 4*r* in the surface 4*s* of the substrate 4 can be suppressed, the metallic coating M can be formed with a uniform film thickness. Furthermore, the shielding member 14 extending to the cathode side with respect to the anode 2 allows effectively shielding the lines of electric force. Since the end surface in the cathode side of the shielding member 14 is opposed to the peripheral edge portion of the film formation region 4*r* in the surface 4*s* of the substrate 4 when the voltage is applied, the concentration of the current to the peripheral edge portion of the film formation region 4*r* in the surface 4*s* of the substrate 4 can be easily suppressed by shielding the lines of electric force by the shielding member 14. Subsequently, a description will be given of the configurations of the film formation device and the film formation method for the metallic coating according to the embodiment in detail.

1. Shielding Member

The shielding member is disposed to surround the outer peripheral surface of the anode, and shields the lines of electric force.

Like the shielding member according to the first embodiment, the shielding member extends in the cathode side with respect to the anode in some embodiments. This is because the lines of electric force can be effectively shielded.

Figure 5:
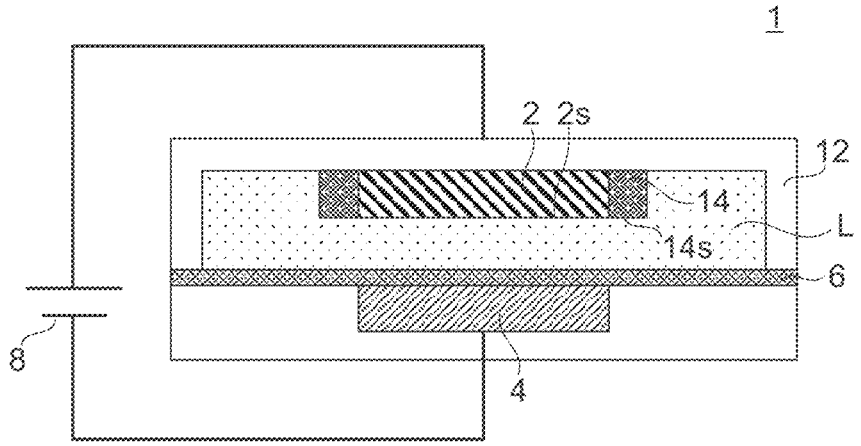
FIG. 5 is a schematic cross-sectional view illustrating a film formation device for a metallic coating according to a second embodiment, and illustrates a schematic cross-sectional surface of a main part including a solution container and a substrate.

FIG. 5 is a schematic cross-sectional view illustrating a film formation device for a metallic coating according to a second embodiment, and illustrates a schematic cross-sectional surface of a main part including a solution container and a substrate. As the shielding member, like a shielding member 14 according to the second embodiment, the shielding member 14 may have an end surface 14*s* in the cathode side disposed on the same plane as the surface 2*s* of the anode 2. Even this shielding member can suppress the concentration of the current to the peripheral edge portion of the film formation region in the surface of the substrate by bringing the surface of the anode close to the film formation region in the surface of the substrate.

While the shape and the size of the shielding member in plan view are not specifically limited, usually, they correspond to the shape and the size of the anode in plan view.

Therefore, the shape of the shielding member in plan view is a rectangular frame shape when the shape of the anode in plan view is a rectangular shape as the first embodiment, and is a doughnut shape when the shape of the anode in plan view is a circular shape. While the shape and the size of the opening of the shielding member in plan view are not specifically limited, usually, they are the same as those of the anode.

While the material of the shielding member is not specifically limited insofar as it is an insulator that can shield the lines of electric force, the material of the shielding member has a chemical resistance to the solution containing the metal ions in some embodiments. The material of the shielding member is polytetrafluoroethylene (PTFE), polyetheretherketone (PEEK), polyvinyl chloride (PVC), polypropylene (PP), or the like in some embodiments. This is because the lines of electric force can be effectively shielded and the chemical resistance is high. While the thickness of the shielding member is not specifically limited insofar as the thickness is enough to shield the lines of electric force, the thickness is, for example, about a few mm in some embodiments.

2. Anode

While the anode is not specifically limited, for example, the anode has the chemical resistance to the solution containing the metal ions and has a conductivity enough to act as the anode.

While the shape of the anode is not specifically limited, the surface of the anode is parallel to the end surface in the cathode side of the solid electrolyte membrane as the anode according to the first embodiment in some embodiments. While the shape and the size of the anode in plan view are not specifically limited, usually, they correspond to the shape and the size of the film formation region in the surface of the substrate in plan view. This is because the lines of electric force from the anode toward the film formation region can be made uniform, thus allowing formation of the metallic coating excellent in uniformity of the film thickness. The shape and the size include the shape in plan view similar to the film formation region in the surface of the substrate and the size in plan view smaller or larger than the film formation region in the surface of the substrate as the anode according to the first embodiment, the shape and the size in plan view which are the same as those of the film formation region in the surface of the substrate, and the like.

While the material of the anode is not specifically limited, the material of the anode includes a metal having a low ionization tendency compared with the metal of the metal ions (high standard electrode potential compared with the metal of the metal ions), a metal more precious than the metal of the metal ions, and the like. This metal includes, for example, gold.

3. Solid Electrolyte Membrane

The solid electrolyte membrane is disposed between the anode and the substrate that serves as the cathode.

The solid electrolyte membrane contains a solid electrolyte. The solid electrolyte membrane internally contains the metal ions by the contact with the solution containing the metal ions, and the metal ions internally contained in the solid electrolyte membrane are deposited on the surface of the substrate by applying the voltage between the anode and the cathode. While the solid electrolyte membrane is not specifically limited insofar as it is one as described above, the solid electrolyte membrane includes a fluorine-based resin, such as Nafion (registered trademark) manufactured by DuPont, a hydrocarbon resin, a polyamic acid membrane, a membrane with ion exchange function, such as Selemion (CMV, CMD, CMF, and the like) manufactured by AGC Inc., and the like.

4. Solution Container

The solution container contains the solution containing the metal ions (hereinafter referred to as a "metal ion solution" in some cases) between the anode and the solid electrolyte membrane.

While the material of the solution container is not specifically limited insofar as the metal ion solution can be contained between the anode and the solid electrolyte membrane, the material of the solution container has the chemical resistance to the metal ion solution and can shield the lines of electric force in some embodiments.

The metal ion solution is a solution that contains the metal contained in the metallic coating in the state of the metal ions. While the metal of the metal ions is not specifically limited, copper, nickel, silver, gold, and the like are included. The metal ion solution is obtained by dissolving the metal of the metal ions with an acid, such as nitric acid, phosphoric acid, succinic acid, nickel sulfate, and pyrophosphoric acid.

5. Others

The power supply device (power supply unit) applies the voltage between the anode and the cathode. The pressure device (pressurizing unit) pressurizes the solid electrolyte membrane to the cathode side with the fluid pressure of the solution.

While the pressure device is not specifically limited, the pressure device includes, for example, a pump that supplies the metal ion solution to the inside of the solution container, adjusts the fluid pressure of the metal ion solution inside the solution container, and pressurizes the solid electrolyte membrane to the cathode side with the fluid pressure of the metal ion solution, as the pressure device according to the first embodiment.

6. Film Formation Device for Metallic Coating

The film formation device for the metallic coating deposits the metal ions internally contained in the solid electrolyte membrane by applying the voltage while pressurizing the surface of the substrate by the solid electrolyte membrane, thereby forming the metallic coating on the surface of the substrate.

The film formation device for the metallic coating may cause the end surface in the cathode side of the shielding member to be opposed to the peripheral edge portion of the film formation region in the surface of the substrate when the voltage is applied as the film formation device for the metallic coating according to the first embodiment. This is because shielding the lines of electric force by the shielding member allows easily suppressing the concentration of the current to the peripheral edge portion of the film formation region in the surface of the substrate.

Here, the "film formation region in the surface of the substrate" means a region in which the metallic coating is formed in the surface of the substrate. The film formation region in the surface of the substrate may be the entire surface of the substrate as the first embodiment, or may be a part of the surface of the substrate.

Figure 4B:
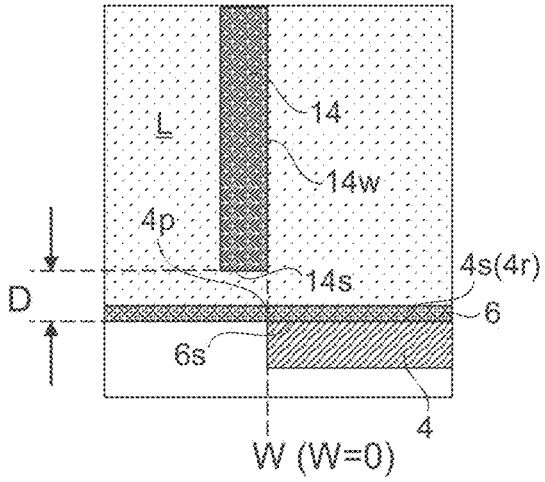
FIG. 4B is an enlarged view corresponding to FIG. 4A in a modification of the first embodiment.
Figure 4C:
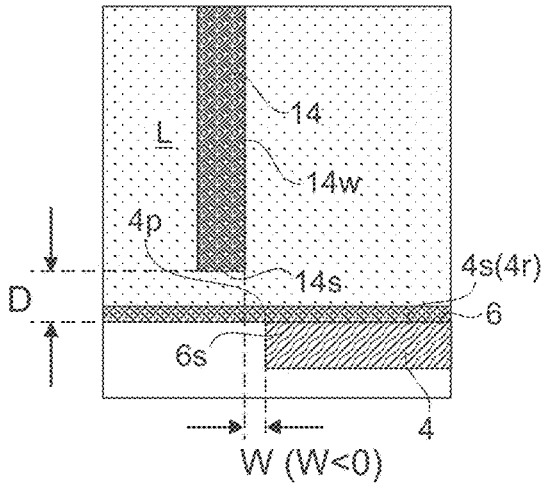
FIG. 4C is an enlarged view corresponding to FIG. 4A in a modification of the first embodiment.

Here, FIG. 4B and FIG. 4C are enlarged views corresponding to FIG. 4A in modifications of the first embodiment. "Cause the end surface in the cathode side of the shielding member to be opposed to the peripheral edge portion of the film formation region in the surface of the substrate" means that the shielding member reduction width $W \geq 0$ is set so as to allow suppressing the current density variation in the film formation region in the surface of the substrate by suppressing the concentration of the current to the peripheral edge portion of the film formation region in the surface of the substrate as illustrated in FIG. 4A and FIG. 4B. The "shielding member reduction width W" means a distance from the peripheral edge 4*p* of the film formation region 4*r* in the surface 4*s* of the substrate 4 in plan view to an inner peripheral surface 14*w* of the shielding member 14 as illustrated in FIG. 4A to FIG. 4C. The shielding member reduction width W has a positive value when the inner peripheral surface 14*w* of the shielding member 14 is inside the peripheral edge 4*p* of the film formation region 4*r*, and has a negative value when the inner peripheral surface 14*w* of the shielding member 14 is outside the peripheral edge 4*p* of the film formation region 4*r*. The "current density variation" is represented by, for example, (current density maximum value in film formation region−current density minimum value in film formation region)/current density in the center of film formation region×100 [%].

The film formation device for the metallic coating may have the shielding member reduction width W<0 without causing the end surface 14*s* in the cathode side of the shielding member 14 to be opposed to the peripheral edge portion of the film formation region 4*r* in the surface 4*s* of the substrate 4 when the voltage is applied as illustrated in FIG. 4C. Even in this case, the current density variation in the film formation region in the surface of the substrate can be suppressed.

In the film formation device for the metallic coating, the shielding member gap D is appropriately set as well as the shielding member reduction width W, thereby allowing controlling the shielding action of the lines of electric force by the shielding member. The "shielding member gap D" means a distance from the end surface 14*s* in the cathode side of the shielding member 14 to the end surface 6*s* in the cathode side of the solid electrolyte membrane 6 as illustrated in FIG. 4A to FIG. 4C, and corresponds to a distance from the end surface 14*s* in the cathode side of the shielding member 14 to the surface 4*s* of the substrate 4 when the voltage is applied.

Figure 6A:
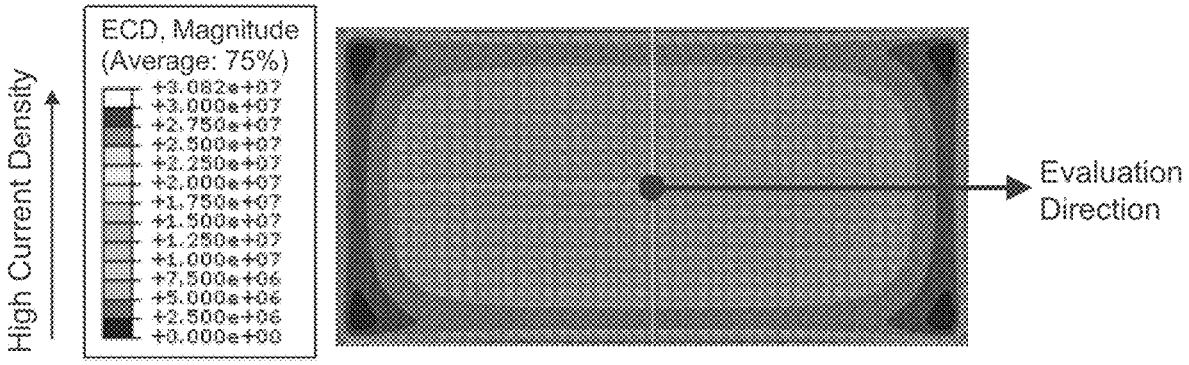
FIG. 6A is an image illustrating a current density distribution in a film formation region analyzed under a condition in which a ratio of a shielding member reduction width W is 2.5% and a ratio of a shielding member gap D is 20%.
Figure 6B:
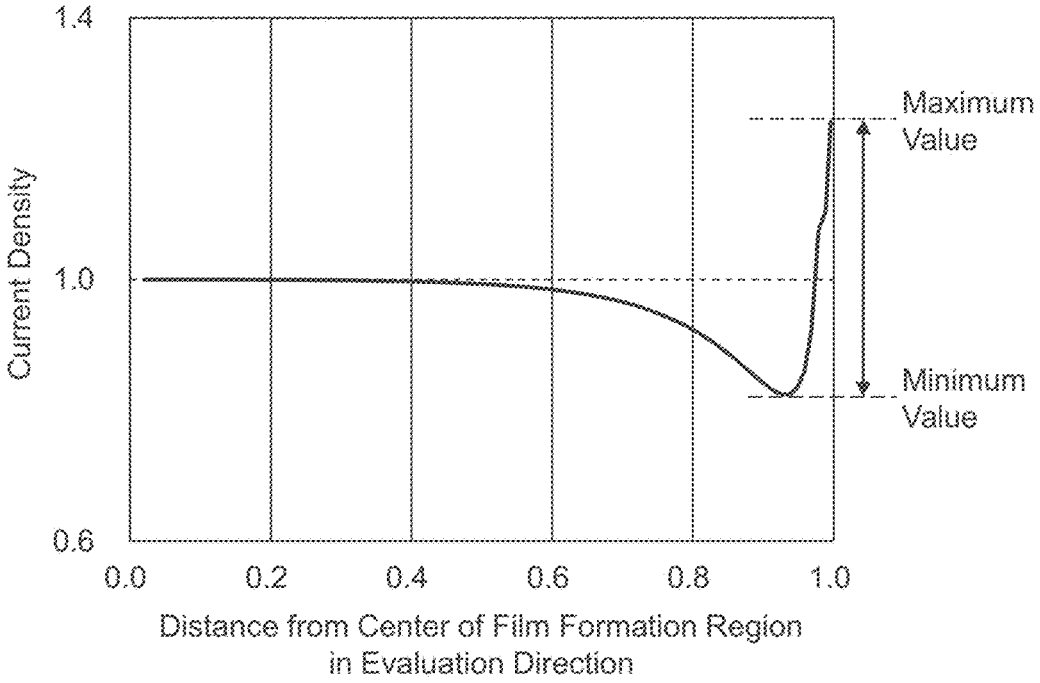
FIG. 6B is a graph illustrating a change of the current density from the center to a peripheral edge of the film formation region in an evaluation direction parallel to a long side illustrated in FIG. 6A.

Here, a description will be given of an analysis result of the current density in the film formation region when the voltage is applied between the anode and the cathode in the case where the sizes of the anode 2 and the opening 14*h* of the shielding member 14 in plan view and the length of the shielding member 14 extending toward the cathode side are adjusted to change the ratios of the reduction width W and the gap D of the shielding member 14 in the film formation device 1 for the metallic coating according to the first embodiment. In the analysis, Abaqus manufactured by Dassault Systèmes S.E. was used as analysis software. A proportion of the shielding member reduction width W to a distance from the center to the peripheral edge of the film formation region in an evaluation direction parallel to the long side was defined as the ratio of the reduction width W, and a proportion of the shielding member gap D to this distance was defined as the ratio of the gap D. In the cases where the ratio of the shielding member reduction width W and the ratio of the shielding member gap D were set to respective values, the current densities at respective positions in the film formation region were calculated, thus obtaining a current density distribution in the film formation region. FIG. 6A is an image illustrating the current density distribution in the film formation region analyzed under a condition in which the ratio of the shielding member reduction width W was 2.5% and the ratio of the shielding member gap D was 20%. FIG. 6B is a graph illustrating the change of the current density from the center to the peripheral edge of the film formation region in the evaluation direction parallel to the long side illustrated in FIG. 6A. In this graph, the horizontal axis indicates the distance from the center of the film formation region in the evaluation direction assuming that the distance from the center to the peripheral edge of the film formation region in the evaluation direction is 1, and the vertical axis indicates the current density assuming that the current density in the center of the film formation region in the evaluation direction is 1.

Figure 7:
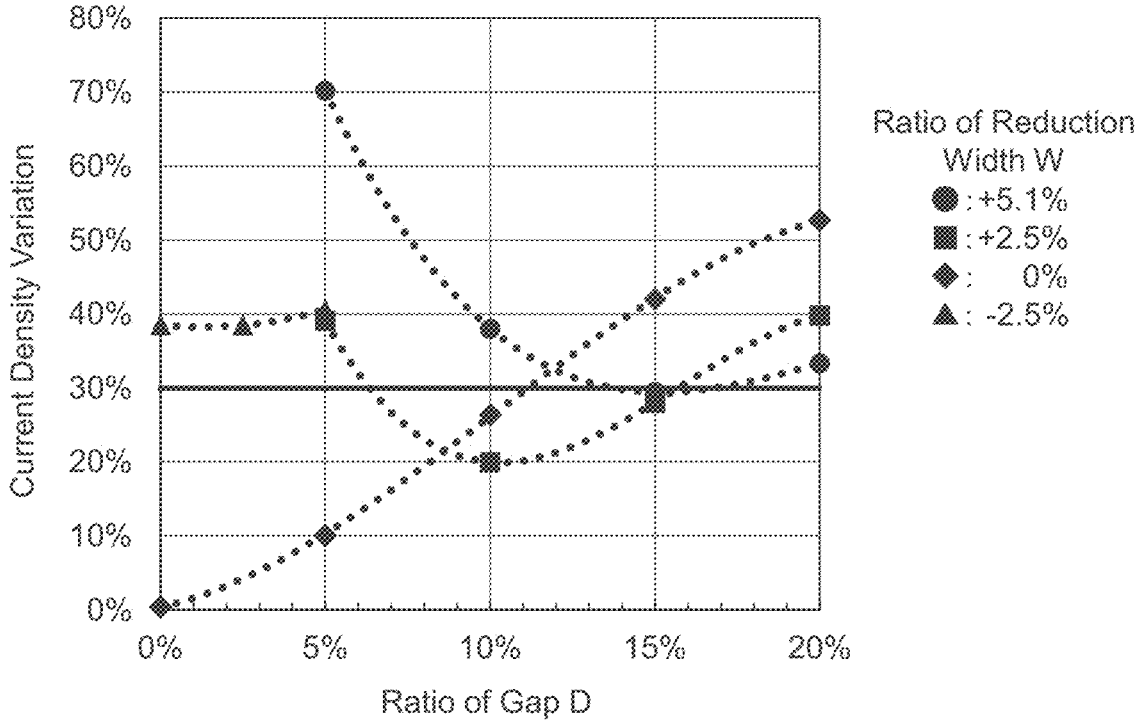
FIG. 7 is a graph illustrating changes of the current density variation with respect to the ratio of the shielding member gap D in cases where the ratio of the shielding member reduction width W is set to respective values.
Figure 8:
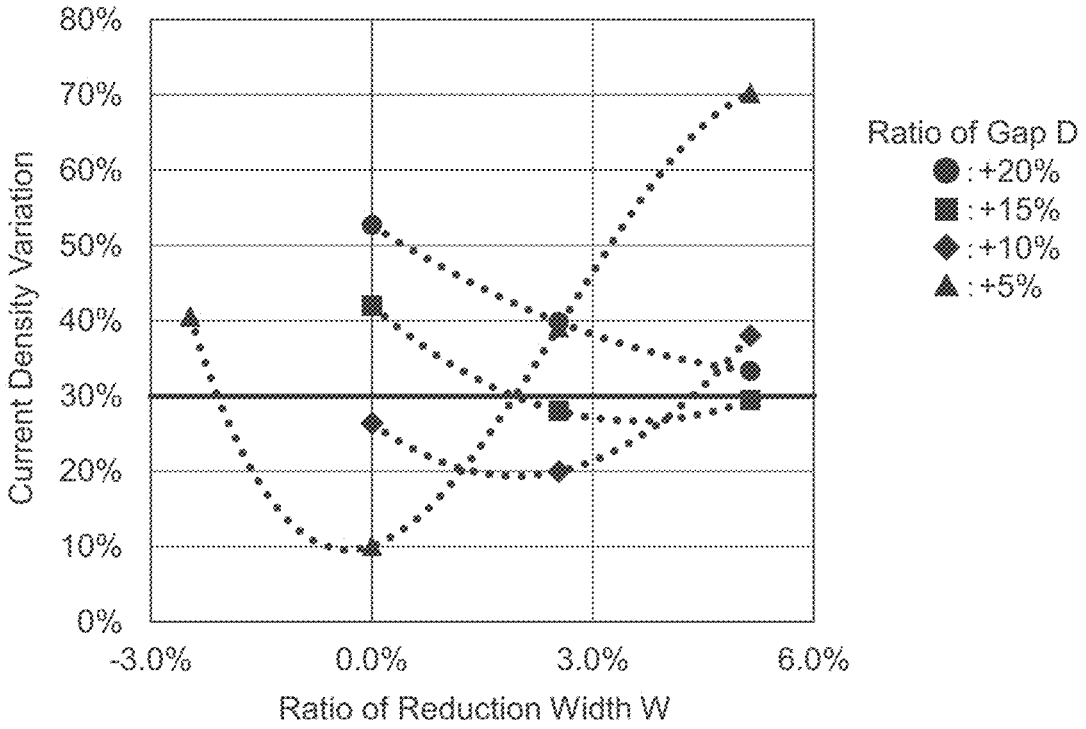
FIG. 8 is a graph illustrating changes of the current density variation with respect to the ratio of the shielding member reduction width W in cases where the ratio of the shielding member gap D is set to respective values.
Figure 9:
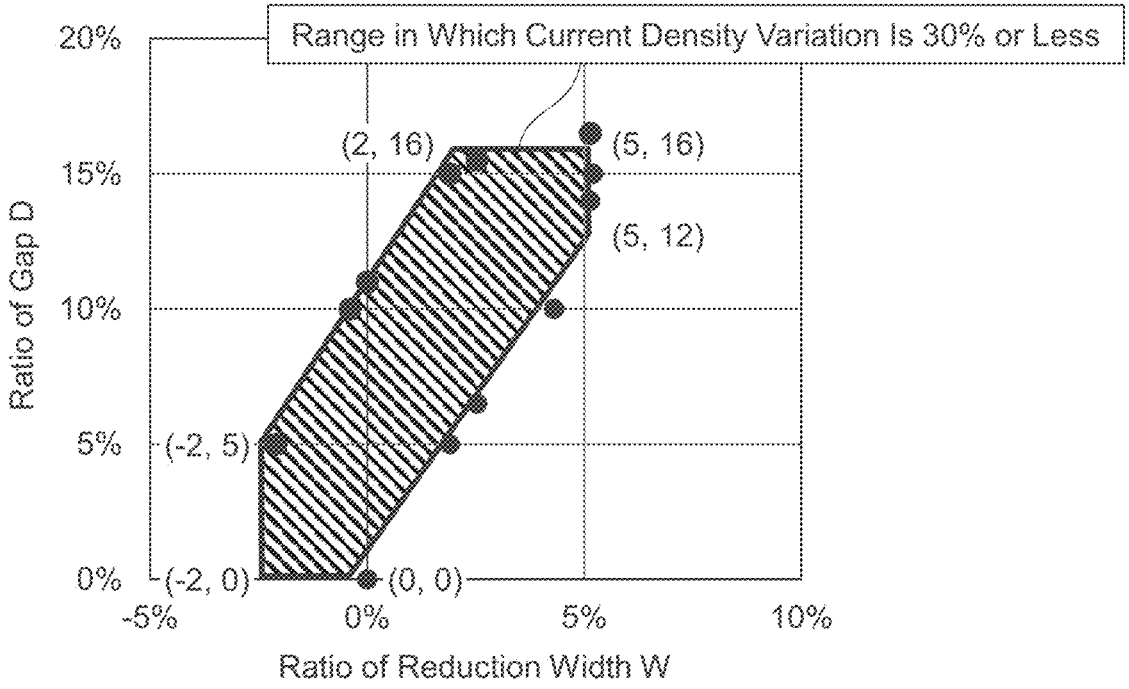
FIG. 9 is a graph illustrating coordinates having the current density variation of 30% or less by dots and illustrating an intended range having the current density variation of 30% or less in a coordinate system having the ratio of the shielding member reduction width W and the ratio of the shielding member gap D as an X coordinate and a Y coordinate, respectively.

From the result of the analysis described above, a description will be given of the calculation result of the current density variation in the cases where the ratio of the shielding member reduction width W and the ratio of the shielding member gap D were set to the respective values. In this calculation, the maximum value and the minimum value of the current density from the center to the peripheral edge in the evaluation direction as illustrated in FIG. 6B of the film formation region were used as the maximum value and the minimum value of the current density in the film formation region, thus calculating the current density variation represented by (current density maximum value in film formation region—current density minimum value in film formation region)/current density in the center of film formation region×100 [%]. FIG. 7 is a graph illustrating changes of the current density variation with respect to the ratio of the shielding member gap D in cases where the ratio of the shielding member reduction width W was set to the respective values. FIG. 8 is a graph illustrating changes of the current density variation with respect to the ratio of the shielding member reduction width W in cases where the ratio of the shielding member gap D was set to the respective values. FIG. 9 is a graph illustrating coordinates having the current density variations of 30% or less by dots and illustrating an intended range having the current density variation of 30% or less in a coordinate system having the ratio of the shielding member reduction width W and the ratio of the shielding member gap D as an X coordinate and a Y coordinate, respectively.

The film formation device for the metallic coating may have a combination of the ratio of the shielding member reduction width W and the ratio of the shielding member gap D in a range having the coordinates of (−2, 0), (−2, 5), (2, 16), (5, 16), (5, 12), and (0, 0) illustrated in FIG. 9 as apexes. This is because the current density variation becomes 30% or less and an effect of allowing formation of the metallic coating with the uniform film thickness becomes remarkable.

7. Film Formation Method for Metallic Coating

The film formation method for the metallic coating is a film formation method for a metallic coating that includes: disposing a solid electrolyte membrane between an anode and a substrate that serves as a cathode, and forming a metallic coating on a surface of the substrate by applying a voltage between the anode and the cathode while pressurizing the surface of the substrate by the solid electrolyte membrane with a fluid pressure of a solution to deposit metal ions internally contained in the solid electrolyte membrane. The solution is disposed between the anode and the solid electrolyte membrane, and the solution contains the metal ions. The film formation method forms the metallic coating by applying the voltage in a state where a shielding member is disposed to surround an outer peripheral surface of the anode. The shielding member shields lines of electric force.

The film formation method for the metallic coating may be a method in which the shielding member extends toward the cathode side with respect to the anode as the film formation method for the metallic coating according to the first embodiment. This is because the lines of electric force can be effectively shielded. The film formation method for the metallic coating may be a method in which an end surface in the cathode side of the shielding member is opposed to a peripheral edge portion of a film formation region in the surface of the substrate when the voltage is applied as the film formation method for the metallic coating according to the first embodiment. This is because shielding the lines of electric force by the shielding member allows easily suppressing the concentration of the current to the peripheral edge portion of the film formation region in the surface of the substrate.

Figure 10:
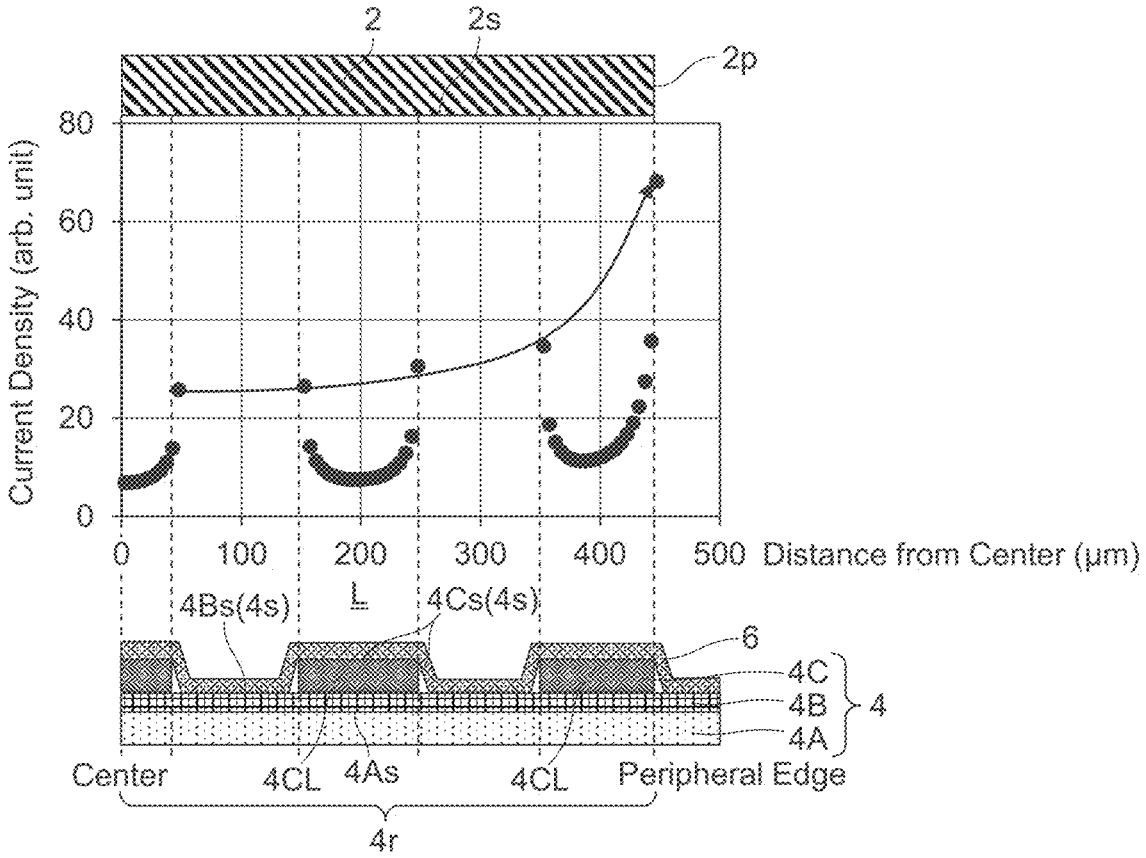
FIG. 10 is a schematic cross-sectional view illustrating a main part of a film formation method for a wiring pattern according to a conventional technique.

Here, a film formation method for a wiring pattern as a film formation method for a metallic coating according to a third embodiment will be described in comparison with a conventional technique. FIG. 10 is a schematic cross-sectional view illustrating a main part of a film formation method for a wiring pattern according to the conventional technique. FIG. 10 also illustrates a graph that indicates a relative change of the current density from the center to the peripheral edge of the film formation region in the evaluation direction perpendicular to an extending direction of the wiring by dots. In contrast, FIG. 11 is a schematic cross-sectional view illustrating a main part of the film formation method for the wiring pattern as the film formation method for the metallic coating according to the third embodiment.

In the film formation method for the wiring pattern according to the conventional technique, as illustrated in FIG. 10, a copper coating (metallic coating, not illustrated) is formed on a film formation region 4*r* in a surface 4*s* of a substrate 4 with a seed layer. The substrate 4 with the seed layer includes an insulating substrate 4A, a conductive base layer 4B disposed on a surface 4As of the insulating substrate 4A, and a seed layer 4C disposed on a surface 4B*s* of the base layer 4B. It is inferred that the surface 4Bs of the base layer 4B includes an exposed region on which the seed layer 4C is not disposed, and the exposed region contains an oxide, thus having a high activation energy to a reduction reaction of the metal ions compared with a surface 4Cs of the seed layer 4C. The seed layer 4C includes a wiring pattern that includes a copper wiring 4CL of line/space=100 μm/100 μm. In the film formation method for the wiring pattern according to the conventional technique, when a copper coating is formed on the film formation region 4*r* in the surface 4*s* of the substrate 4 with the seed layer, as illustrated in FIG. 10, the solid electrolyte membrane 6 is deformed to follow the seed layer 4C and the base layer 4B with the fluid pressure of the metal ion solution L containing copper ions arranged between the anode 2 and the solid electrolyte membrane 6, and a voltage is applied between the anode 2 and the seed layer 4C with the base layer 4B while pressurizing the surface 4Cs of the seed layer 4C and the surface 4Bs of the base layer 4B by the solid electrolyte membrane 6, thereby depositing the copper ions internally contained in the solid electrolyte membrane 6. Accordingly, the copper coating is formed on the surface 4Cs of the seed layer 4C in the film formation region 4*r* in the surface 4*s* of the substrate 4 with the seed layer. At this time, as seen from the graph of the current density illustrated together in FIG. 10, the current concentrates on the copper wiring 4CL in the peripheral edge portion of the film formation region 4*r*, thus causing the current density variation among a plurality of copper wirings 4CL of the seed layer 4C in some cases.

Figure 11:
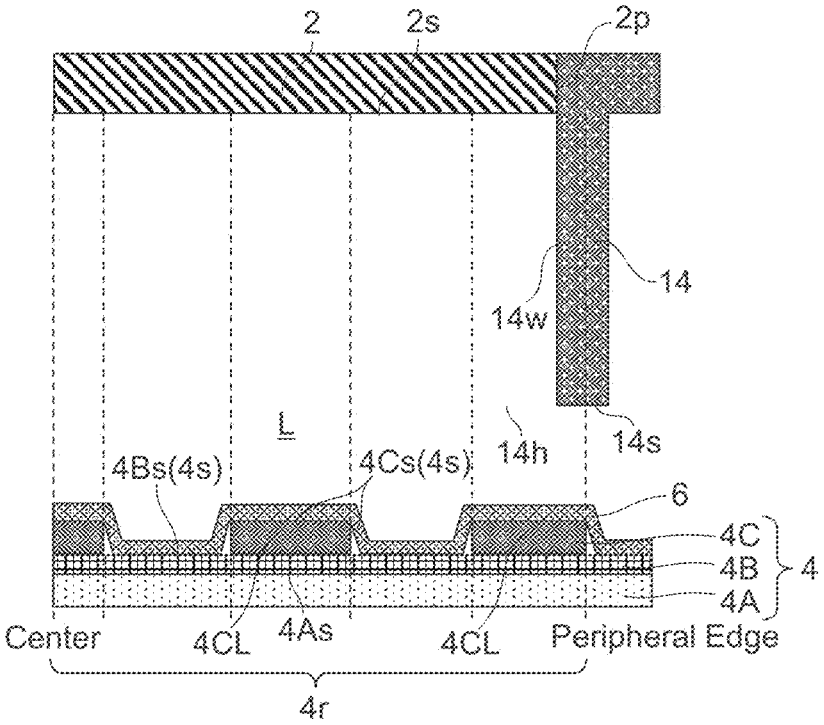
FIG. 11 is a schematic cross-sectional view illustrating a main part of a film formation method for a wiring pattern as a film formation method for a metallic coating according to a third embodiment.

In contrast, in the film formation method for the wiring pattern according to the third embodiment, when a copper coating (metallic coating, not illustrated) is formed on the film formation region 4*r* in the surface 4*s* of the similar substrate 4 with the seed layer, as illustrated in FIG. 11, the lines of electric force from the anode 2 are shielded by the shielding member 14 by applying the voltage between the anode 2 and the base layer 4B with the seed layer 4C in a state where the shielding member 14 for shielding the lines of electric force is disposed to surround the outer peripheral surface 2*p* of the anode 2, thereby allowing suppressing the concentration of the current on the copper wiring 4CL in the peripheral edge portion of the film formation region 4*r*. Accordingly, generation of the current density variation among the plurality of copper wirings 4CL on the seed layer 4C in the film formation region 4*r* can be suppressed, thus allowing formation of the wiring pattern including the plurality of copper wirings 4CL in which the copper coating is formed with the uniform film thickness.

While the substrate that serves as the cathode is not specifically limited insofar as it serves as the cathode and the metallic coating can be formed on the surface of the substrate, the substrate that serves as the cathode includes a substrate with a wiring pattern in which the wiring pattern is disposed on a surface of an insulating substrate, such as the substrate with the seed layer according to the third embodiment, in addition to, for example, a substrate formed of a metal, such as aluminum, and a substrate in which a metal base layer is disposed on a treated surface of a resin substrate, a silicon substrate, or the like. According to the embodiment, when the metallic coating is formed on the surface of the wiring pattern of the substrate with the wiring pattern, the concentration of the current on the wiring in the peripheral edge portion of the film formation region can be suppressed, thus allowing formation of the wiring pattern including a plurality of wirings in which the metallic coating is formed with the uniform film thickness.

When the film formation method for the metallic coating is used, for example, the metallic coating can be formed using the film formation device for the metallic coating according to the embodiment.

While the embodiments of the present disclosure have been described in detail above, the present disclosure is not limited thereto, and can be subjected to various kinds of changes in design without departing from the spirit of the present disclosure described in the claims.

All publications, patents and patent applications cited in the present description are herein incorporated by reference as they are.

DESCRIPTION OF SYMBOLS

1 Film formation device for metallic coating
2 Anode
2*s* Surface of anode
2*p* Outer peripheral surface of anode
4 Substrate (cathode)
4*s* Surface of substrate
4*r* Film formation region in surface of substrate
4*p* Peripheral edge of film formation region
6 Solid electrolyte membrane
6*s* End surface in cathode side of solid electrolyte membrane
8 Power supply device
12 Solution container
12*h* Opening of solution container
14 Shielding member
14*s* End surface in cathode side of shielding member
14*h* Opening of shielding member
14*w* Inner peripheral surface of shielding member
30*b* Pump (pressure device)
L Metal ion solution
M Metallic coating

What is claimed is:

1. A film formation device for a metallic coating, comprising:

an anode;

a solid electrolyte membrane disposed between the anode and a substrate that serves as a cathode;

a power supply device that applies a voltage between the anode and the cathode;

a solution container that contains a solution between the anode and the solid electrolyte membrane, the solution containing metal ions; and a pressure device that pressurizes the solid electrolyte membrane to the cathode side with respect to the solid electrolyte membrane with a fluid pressure of the solution, wherein a metallic coating is formed on a surface of the substrate by applying the voltage while pressurizing the surface of the substrate by the solid electrolyte membrane to deposit the metal ions internally contained in the solid electrolyte membrane, wherein the film formation device for the metallic coating further includes a shielding member disposed to surround an outer peripheral surface of the anode, and the shielding member shields a line of electric force, wherein the film formation device for the metallic coating has a combination of a ratio (%) of a shielding member reduction width W and a ratio (%) of a shielding member gap D in a range having coordinates of (−2, 0), (−2, 5), (2, 16), (5, 16), (5, 12), and (0, 0) as apexes in a coordinate system having the ratio (%) of the shielding member reduction width W and the ratio (%) of the shielding member gap D as an X coordinate and a Y coordinate, respectively, wherein the shielding member reduction width W is a distance from a peripheral edge of a film formation region in which the metallic coating is formed in the surface of the substrate in plan view to an inner peripheral surface of the shielding member, the shielding member reduction width W has a positive value when the inner peripheral surface of the shielding member is inside the peripheral edge of the film formation region, and the shielding member reduction width W has a negative value when the inner peripheral surface of the shielding member is outside the peripheral edge of the film formation region, wherein the shielding member gap D is a distance from an end surface facing the cathode of the shielding member to an end surface facing the cathode of the solid electrolyte membrane, and wherein the ratio (%) of the shielding member reduction width W is a proportion of the shielding member reduction width W to a distance from a center to the peripheral edge of the film formation region, and the ratio (%) of the shielding member gap D is a proportion of the shielding member gap D to the distance from the center to the peripheral edge of the film formation region.

2. The film formation device for the metallic coating according to claim 1, wherein the shielding member extends toward the cathode side with respect to the anode.

3. The film formation device for the metallic coating according to claim 1, wherein the shielding member reduction width $W \geq 0$ is satisfied.

* * * * *